US005938100A

United States Patent [19]

Bloser et al.

[11] Patent Number: 5,938,100

[45] Date of Patent: Aug. 17, 1999

[54] MECHANISM FOR TRANSPORTING THE LEADING END OF A STAPLE WIRE FROM A SUPPLY ROLL TO A STAPLING DEVICE FOR SHEET STACKS

[75] Inventors: Helmut Bloser, Lonsee; Juergen Ries, Ostfildern, both of Germany

[73] Assignee: Eastman Kodak Company, Rochester, N.Y.

[21] Appl. No.: 09/047,618

[22] Filed: Mar. 25, 1998

[30] Foreign Application Priority Data

Mar. 27, 1997 [DE] Germany ..... 197 12 862

[51] Int. Cl.[6] ..... B21J 15/30

[52] U.S. Cl. ..... 227/107; 227/3; 227/84; 227/131; 270/37

[58] Field of Search ..... 227/82, 84, 2, 227/3, 131, 107, 86, 93, 92; 270/37; 242/564.2

[56] References Cited

U.S. PATENT DOCUMENTS

| | | | |
|---|---|---|---|
| T958,003 | 5/1977 | Russel et al. | 227/2 |
| 3,514,027 | 5/1970 | Linden | 227/92 |
| 3,642,187 | 2/1972 | Barland | 227/84 |
| 4,722,467 | 2/1988 | Kunka et al. . | |
| 4,898,314 | 2/1990 | Stroh . | |
| 5,106,066 | 4/1992 | Shea et al. | 227/2 |
| 5,788,139 | 8/1998 | Sikora | 227/84 |

FOREIGN PATENT DOCUMENTS

| | | | |
|---|---|---|---|
| 215279 | 11/1984 | Germany | 227/2 |
| 38 39 297 | 5/1990 | Germany . | |

*Primary Examiner*—Scott A. Smith
*Assistant Examiner*—James P. Calve
*Attorney, Agent, or Firm*—Lawrence P. Kessler

[57] ABSTRACT

Stapling devices, which form staples from a staple wire transported from supply rolls, are arranged in a stapling apparatus. The supply rolls are associated with a threading-in device which is mounted displaceably on the stapling apparatus. Transport mechanisms as well as feed-in and guide mechanisms are associated with each supply roll. Flexible guide tubes connect the threading-in device to the respective stapling device. The threading-in device can be moved into a position pulled out of the stapling apparatus device, in which the supply rolls can easily be inserted. The leading end of the wire is pushed, in simple and conveniently visible fashion, between a transport roller pair by way of a guide element and a funnel-shaped feed-in tube. From there the leading end of the wire is pushed by manual drive through the flexible guide tube to a transport mechanism on the stapling device until, upon passing by a switch, the end of the manual threading-in operation, and the fact that the staple wire is ready for automatic continued transport, are indicated. The threading-in device is pushed into the stapling apparatus after completion of the threading-in operation.

15 Claims, 3 Drawing Sheets

MECHANISM FOR TRANSPORTING THE LEADING END OF A STAPLE WIRE FROM A SUPPLY ROLL TO A STAPLING DEVICE FOR SHEET STACKS

BACKGROUND OF THE INVENTION

The invention relates to a mechanism for transporting the leading end of a staple wire from a supply roll to a stapling device for sheet stacks via a guide tube for the staple wire arranged between the staple wire supply roll and the stapling device, such mechanism having a movable holder on which the staple wire supply roll is mounted, the holder with the staple wire supply spool being movable between a position arranged inside an apparatus and a position projecting beyond the outside of the apparatus.

In the case of a mechanism of the type disclosed by U.S. Pat. No. 4,898,314, the staple wire is arranged in a cassette, and a flexible guide tube, which is joined to the cassette and whose outlet is configured as a coupling to which the wire end is attached, is provided. The staple wire is joined by means of said coupling to a wire transport mechanism, arranged in the region of the stapling device, which transports the staple wire into the stapling device. With this known mechanism, a complete unit consisting of a cassette, a guide tube, and a coupling must be replaced each time the supply of staple wire is to be replenished. When a new supply of staple wire is inserted, the coupling joined to it must be moved manually to the immediate vicinity of the stapling device.

In another mechanism for transporting the leading end of the wire to a stapling device (U.S. Pat. No. 4,722,467), a threading-in mechanism which has a funnel-shaped inlet opening for the wire end is provided directly upstream from the stapling device. The wire end is introduced manually into said inlet opening, and pushed forward until the leading end arrives at visible marks, from which point wire transport on the part of the stapling device becomes effective. At the beginning of the threading-in process, a clamping mechanism for the wire must be moved manually into an ineffective position, and, once the threaded-in position is reached, must be moved into a clamping position which prevents the staple wire from slipping back.

In the case of a loading mechanism for a staple wire roll disclosed in Research Disclosure No. 29834, May 1988, a displaceable holder is provided on which the staple wire roll is mounted. The holder is movable from a location arranged inside an apparatus into a pulled-out location in which the staple wire roll is positioned to be accessible for replacement. With this mechanism, the leading end of the staple wire must be pushed manually into a flexible tube leading to a transport mechanism of a stapling head until the leading wire end has arrived at the transport mechanism.

With these known and in some cases relatively complex mechanisms, it is necessary to transport the wire end by hand to the immediate vicinity of the stapling device. Since the stapling device of a stapling apparatus, which can for example be arranged in a finisher for folding, collating, stapling, and depositing sheet stacks, is as a rule arranged at a poorly accessible point in the apparatus, replenishing the staple wire supply is, with the known devices, so complex and laborious that it can be performed only by trained personnel.

SUMMARY OF THE INVENTION

It is the object of the invention to configure a staple wire transport mechanism of the generic type such that it allows easy and convenient handling, and is of simple design.

According to the invention, this object is attained in that the movable holder is configured as a threading-in device for at least one staple wire supply roll, on which at least one transport mechanism associated with the leading end of the supply roll is arranged; and the flexible guide tube leading to the transport mechanism of the stapling device is arranged at the outlet of the transport mechanism of the threading-in device.

According to the invention, the object is further attained in that the movable holder is configured as a threading-in device for at least one staple wire supply roll, on which at least one transport mechanism associated with the leading end of the supply roll is arranged; the flexible guide tube leading to the transport mechanism of the stapling device is arranged at the outlet of the transport mechanism of the threading-in device; a sensor arranged in the transport path of the staple wire is arranged on the stapling device, and the sensor is coupled to an indicating means of the threading-in device which signals passage of the leading end of the wire past the transport mechanism of the stapling device; and the transport mechanism of the threading-in device is positively coupled via control means to a pressure roller of the transport mechanism of the stapling device in such a way that when the threading-in device is moved into the stapling apparatus, a pressure roller of the transport mechanism of the threading-in device can be moved into an ineffective position, and the pressure roller of the transport mechanism of the stapling device can be moved into an effective position; and when the threading-in device is moved out of the stapling apparatus, the pressure roller of the transport mechanism of the threading-in device can be moved into an effective position, and the pressure roller of the transport mechanism of the stapling device can be moved into an ineffective position.

In an advantageous modification of the invention, two staple wire supply rolls, with the pertinent guide means, transport means, and feed-in tubes, are arranged on a support, each associated with a stapling device mounted on the apparatus.

In an advantageous and particularly simple manner, when the support is in the position moved out of the apparatus, the leading end of the staple wire is guided manually via an elastic feeding element and pushed into a funnel-shaped opening of a feed-in tube, through which it arrives between a transport roller pair. Because of the pulled-out arrangement of the threading-in device, this threading-in operation is readily visible and can thus be performed easily, conveniently, and without error. Once the staple wire has been thus threaded in, the transport roller pair transports it by manual drive through the downstream guide tube to the respective stapling device, the motor-driven transport mechanism of which then automatically effects wire transport as a function of stack thickness; a sensor which signals correct completion of the manually actuated threading-in operation is arranged in the transport path of the staple wire.

With the mechanism according to the invention, threading-in of the leading end of the wire is accomplished, particularly advantageously, in a manner that is readily visible and easy to manipulate, and entirely independently of the spatial arrangement of the stapling device and devices, respectively, within an apparatus, since the flexible guide tube guides the staple wire to the inaccessible location of the stapling device.

Further features and advantages are evident from the description of an embodiment of the invention depicted in the drawings, and from the subclaims.

DETAILED DESCRIPTION OF THE INVENTION

The mechanism according to the invention, for transporting the leading end of a staple wire supply roll to a stapling device, is part of a stapling apparatus for stacked collection and stapling of sheets and for depositing the stapled sheet products; only those components necessary for an understanding of the mechanism according to the invention are depicted. A stapling device of this kind is known, for example, from DE 38 39 297 A.

Figure 1:
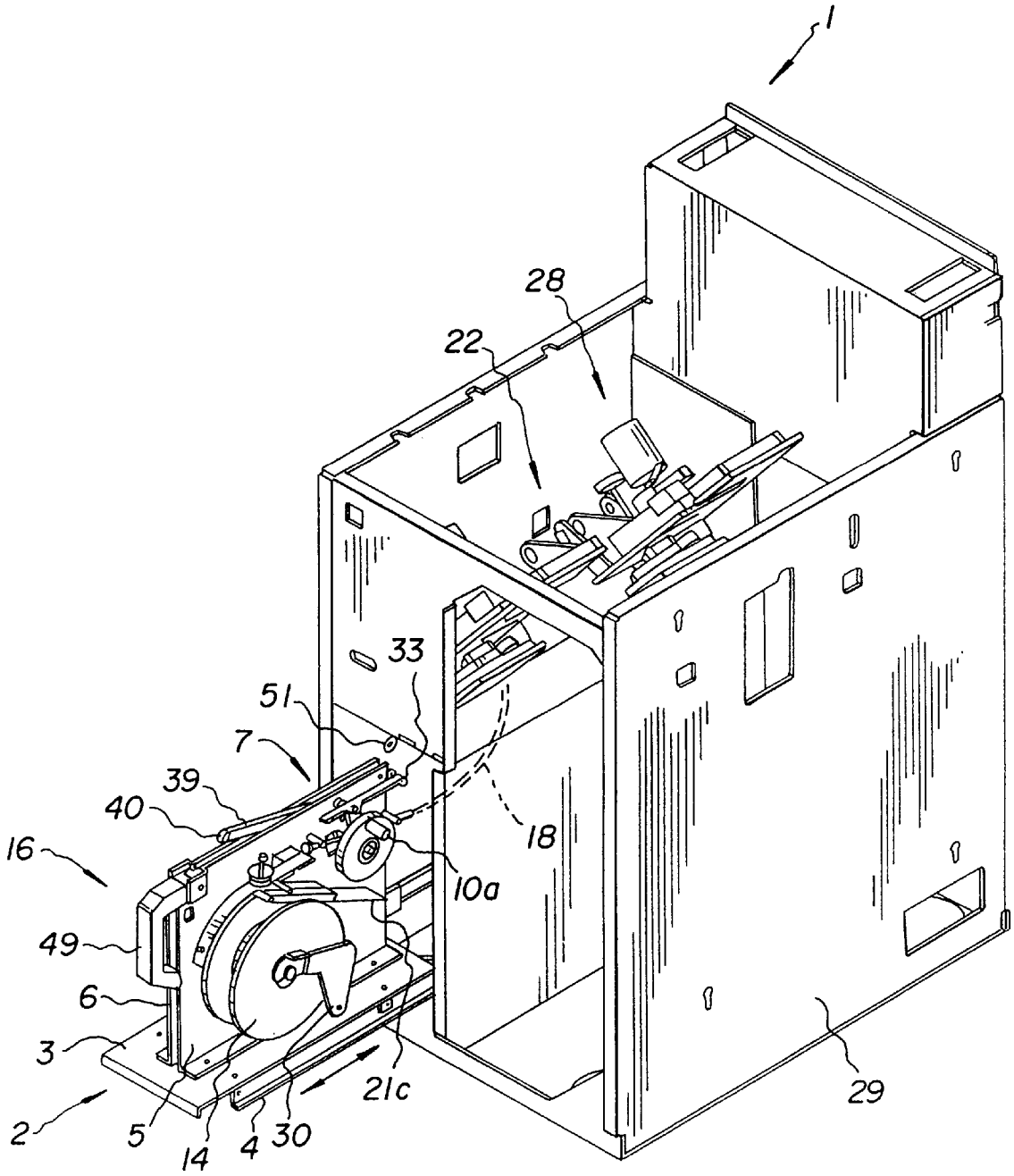
FIG. 1 the mechanism is an oblique view, in a position moved out from the apparatus.

Arranged on housing 29 of stapling apparatus 1, depicted in FIG. 1, are two stapling devices 22 and 28 of a known type, with which, in known fashion, a wire furnished from a supply roll 14 or 16 is automatically shaped into staples as a function of the stack thickness being stapled, and driven into the respective sheet stack. Stapling devices 22 and 28 can be adjusted by displacement, in a known manner that is not depicted, to different staple spacings.

Arranged below stapling devices 22 and 28 on housing 29 is a threading-in device 2 which has a support 3, guided displaceably in a known fashion on pull-out rails 4, which can be pulled out from a position according to FIG. 2, completely pushed into housing 29 and flush with the outside of the apparatus, into a loading position depicted in FIG. 1.

Two vertical walls 5 and 6 running parallel to one another, on each of which a supply roll 14 and 16, respectively, is rotatably mounted, are attached on support 3.

Figure 2:
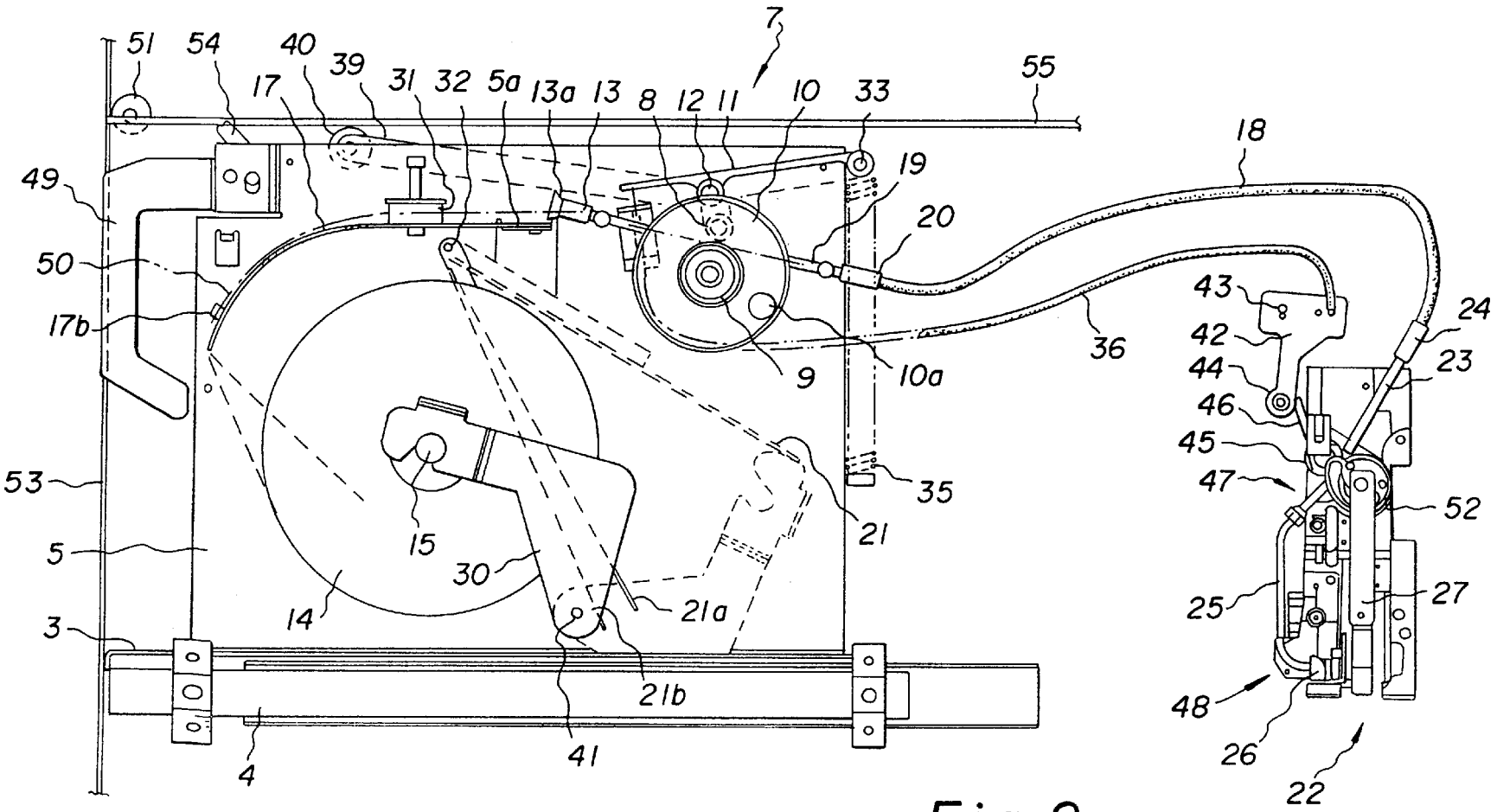
FIG. 2 a partial view of the mechanism of FIG. 1 in a side view, in a position moved into the apparatus.

Associated with these two supply rolls 14 and 16 are identical guide and transport elements 7, 17, of which only one is visible in FIGS. 1 and 2, so that the following description applies identically to both supply rolls 14 and 16.

Supply rolls 14 and 16 are rotatably mounted on stationary spindles 15, and have spool flanges of a known type between which a commercially available coiled roll of staple wire is arranged. Pivotably mounted securing levers 30, which immobilize supply rolls 14 and 16 on spindles 15 in their axial position, are arranged on support 3.

Arranged above supply rolls 14 and 16 are elastic guide elements 17 which are attached at one end 5*a* to wall 5 and 6, respectively. Attached on their top side and at the other end of guide elements 17, which are shaped approximately as circular arcs and are arranged coaxially with supply rolls 14 and 16, is a guide 17*b* which has a hole or a notch (not depicted) for guiding staple wire 50. Elastic guide elements 17 serve, in a manner yet to be described, as strain reliefs and to assist transport of the staple wire.

Associated with guide elements 17 are lubricant carriers 31 which are equipped with oil-impregnated felt pieces of a known type, between which staple wire 50 is guided.

A transport mechanism 7 is attached on walls 5 and 6 as an extension of each of guide elements 17. Transport mechanism 7, visible in particular in FIGS. 2 and 3, has a feed-in tube 13 whose one end has a funnel-shaped opening 13*a* facing guide element 17, and whose other end is directed toward the inlet roller gap of a transport roller pair 8 and 9. The one transport roller 9 is mounted in stationary fashion, and is driven via a handwheel 10, joined to transport roller 9, by means of a handle 10*a* attached thereon. The other transport roller 8, which serves as the pressure roller, is mounted pivotably about a bearing 12 on a lever 11. Transport rollers 8 and 9 are equipped with guide grooves (not depicted) of a known type for staple wire 50.

Arranged between walls 5 and 6 is a two-armed control arm 39 which is also mounted pivotably about bearing 12. Levers 11 mounted on either side of walls 5 and 6, and control arm 39, are joined to one another at their one end by means of a pin 33. Engaging on said pin 33 is a tension spring 35 which acts on levers 11 and control arm 39 so as to rotate them clockwise, so that pivotable transport roller 8 can be laid against stationary transport roller 9. Attached at the other end of levers 11 is one end of a wire 37 of respectively associated sheathed cables (Bowden cables) 36, the sheath of which is attached in a known fashion to stationary mounts 38. The other end of sheathed cable wire 37 is attached to an actuator (yet to be described), which is associated respectively with one of stapling devices 22 or 28.

A rotatable slide roller 40, which comes into engagement with housing 29 in a manner yet to be described, is mounted at the other end of control arm 39.

Associated with the outlet roller gap of transport roller pair 8 and 9 is a guide tube 19 which has a coupling element 20 to which a flexible guide tube 18 of a known type can be connected.

Resting under its own weight against the outside diameter of each of the staple wire rolls located on supply rolls 14 and 16 is a braking and indicating arm 21, which at one end is pivotably articulated about a stationary bearing 32, and whose other end projects beyond the spool flange of supply rolls 14 and 16. Sensors (not depicted) are arranged in the movement path of the end of braking and indicating arm 21 which projects beyond the spool flange. The sensors, configured as photoelectric barriers of a known type, are arranged so that they can indicate two staple wire supply levels depending on the position of braking and indicating arm 21, namely "almost empty" in position 21*a*, and "empty" in position 21*b* (see FIGS. 2 and 3). The photoelectric barriers control corresponding indicating means of a known type (not depicted) on the outside of stapling apparatus 1.

Figure 3:
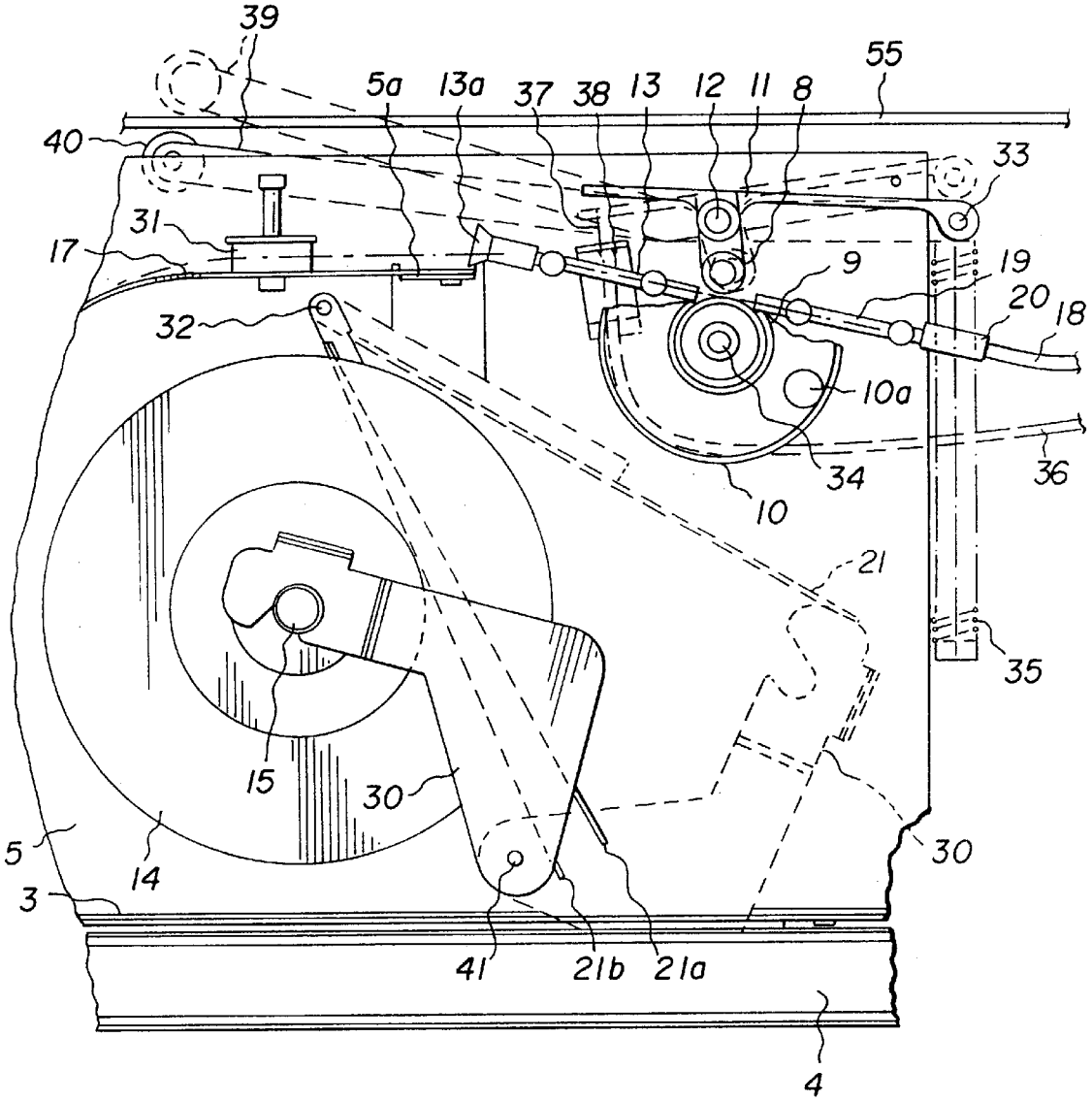
FIG. 3 a partial view of the mechanism of FIG. 2.

As shown in FIG. 1, braking and indicating arms 21 have projections 21*c* which project into the pivot path of securing levers 30 in such a way that when the respective securing lever 30 pivots into the release position, the respective associated braking and indicating arm 21 is lifted away from supply roll 14 or 16 (indicated with dot-dash lines in FIGS. 2 and 3).

Transport mechanisms 7 are joined to stapling devices 22 and 28 by the aforementioned flexible guide tube 18, which can be respectively connected, by means of a coupling element 24 of a known type (not depicted), to an inlet tube 23 of stapling devices 22 and 28.

From inlet tube 23 of stapling device 22 or 28, the staple wire is transported, by means of a driven transport roller 52 mounted on the stapling device and a pressure roller 45 associated therewith, through a feed-in tube 25 to a staple wire cutting means 26 and to a staple forming and staple driving means 27 of a known type. The same applies to the second stapling device 28.

Pressure roller 45 is mounted on the respective stapling device 22 or 28 pivotably on an arm 46. End 44 of an actuator 42, which is mounted pivotably about a stationary bearing 43 and can be actuated by sheathed cable 36, 37 attached thereon, engages on arm 46.

Arranged in the region of the transport mechanism of the stapling device is a first switch 47 of a known type (not depicted), which projects into the transport path of the staple wire and which, when the leading end of the wire passes by pressure roller 45, activates an indicator lamp (not depicted) of a known type on the outside of apparatus 1 and thus signals to the user the end of the manually driven threading-in operation, and the fact that the staple wire is ready for further motorized transport.

Stapling apparatus 1 is loaded with staple wire supply rolls 14 and 16 as follows:

First, a door 53 (indicated in FIG. 2) of a known type (not depicted in further detail) on the front of the apparatus is opened. Threading-in device 2, which is now accessible, is unlocked by turning handle 49, so that a bolt 54 of a locking mechanism of a known type (not depicted) disengages from housing 29. Threading-in device 2 is then pulled out of apparatus 1, using handle 49, to the end position shown in FIG. 1; the connection to stapling devices 22 and 28 is maintained by means of the flexibly configured guide tubes 18. In the pulled-out position, securing levers 30 are pivoted clockwise so that supply spools 14 and 16 are released, and braking and indicating arms 21 are pivoted out of the removal path of supply spools 14 and 16. An empty supply spool 14 or 16 can now be removed unimpeded, and a full supply spool can be placed onto the respective spindle 15.

After the new supply spools 14 and 16 have been put in place, securing levers 30 are pivoted counterclockwise onto spindles 15, thereby pivoting braking and indicating arms 21, which are in contact therewith, against the outside diameter of the coiled staple wire.

The respective leading end of the wire is then grasped manually and guided via guide 17*a* and guide element 17 between lubricant carriers 31, inserted into the funnel-shaped opening 13*a* of feed-in tube 13, and pushed into the roller gap of transport rollers 8, 9 of transport mechanism 7.

By rotating handwheel 10 clockwise using handle 10*a,* the leading end of the wire is then transported through feed-in tube 19 into the flexible guide tube 18, and through the latter to stapling device 22 or 28. Once the leading end has passed by the opened roller gap of transport rollers 45, 52 on the stapling device, it actuates the first switch 47 arranged in its movement path. This activates the aforementioned indicator lamp, which signals to the user the end of the manual threading-in operation and the fact that the staple wire is ready to be automatically transported further by transport rollers 45 and 52 on the stapling device.

Both during the manually actuated staple wire threading-in operation, and during motorized transport of the staple wire at the stapling device, elastic guide element 17 acts as a strain relief for the unwinding of the staple wire from supply rolls 14 and 16, thus preventing any jerky tensile stress on staple wire 50. Elastic guide element 17 also serves as a transport means for rotation of the heavy supply spools 14 and 16, by the fact that guide element 17 is first preloaded by elastic deflection by means of the staple wire as it is being transported, until sufficient energy has been stored to overcome the inertia of supply spools 14 and 16 and rotate them.

Once the manually driven threading-in operation for both staple wire supply rolls 14 and 16 is complete, threading-in device 2 is pushed into stapling apparatus 1. As it is pushed in, control arm 39 strikes with its roller 40 against a housing-mounted roller 51, and is thereby pivoted counterclockwise. This pivoting movement is also transferred by pin 33 to levers 11, which also pivot counterclockwise so that transport roller 8, which serves as pressure roller, is pivoted away to the side and is thus slightly distanced or lifted away from stationary transport roller 9. Upon further insertion of threading-in device 2, roller 40 of control arm 39 moves along a wall 55 of housing 29.

The pivoting movement of levers 11 also causes wire 37 of sheathed cable 36 to be pushed into its stationary sheath, which causes a clockwise pivoting of actuator 42. The pivoting movement of actuator 42 in turn results in a counterclockwise rotation of spring-loaded tracking arm 46, so that pressure roller 45 rests in spring-loaded fashion against the associated transport roller 52 of stapling device 22 and 28, respectively.

The connection by way of sheathed cable 36 thus ensures that pressure roller 45 of stapling device 22 or 28 is effective in functionally correct fashion when the manually actuated threading-in operation is complete.

When threading-in device 2 reaches its pushed-in end position, a switch (not depicted) is actuated and starts up the transport mechanism of the stapling device. The staple wire is then transported by transport rollers 45, 52 until the beginning of the staple wire actuates a second switch 48 (not depicted) projecting into the transport path of the staple wire, which then halts wire transport after a defined delay when the leading end of the wire has reached its starting position in stapling device 22 or 28.

Stapling device 22 or 28 is now in a starting position from which staple shaping, controlled on the basis of stack thickness, can be accomplished automatically.

In the pushed-in end position of threading-in device 2, its bolt 54 automatically snaps into place. Door 49 is then closed.

During the operation of stapling device 22 or 28, an indication of the staple wire supply is provided by braking and indicating arm 21 which, as already mentioned, activates a corresponding indication on the outside of the device. When the staple wire supply is running out, the "almost empty" indication is provided in position 21*a,* and when the staple wire is exhausted, the "empty" indication is given in position 21*b*.

When threading-in device 2 is pulled out into its threading-in position, as already described, to be loaded with new supply rolls 14 and 16, roller 40 of control arm 39 is no longer in contact with wall 55 of housing 29. Control arm 39 is thus released, and pivots clockwise together with levers 11 in response to tension spring 35. During the pivoting movement of lever 11, wire 37, attached thereto, of sheathed cable 36 is pulled, causing its other end to move actuator 42 so as to rotate counterclockwise. As a result, arm 46 pivots pressure roller 45 into a position lifted away from transport roller 52, so that the manually driven threading-in operation can proceed, unimpeded, through the now-open roller gap between pressure roller 45 and transport roller 52.

Because of the control operation described above, however, transport roller 8 serving as the pressure roller rests, under the action of tension spring 35, in functionally correct fashion against the stationary transport roller 9 of transport mechanism 7 of threading-in device 2.

The position of pressure rollers 8 and 45 is thus automatically controlled by sheathed cable 36, as a function of the respective end position of threading-in device 2, in such a way that in both end positions, functionally correct wire transport can occur without interference and without additional actions by the user, thus considerably simplifying the threading-in operation.

In a departure from the embodiment described above, transport mechanism 7 of threading-in device 2 can also be motor-driven (not depicted); the motor drive is deactivated when the leading end of the wire passes by switch 47 on stapling device 22 or 28. The configuration, arrangement, and operation of the mechanism are otherwise as described in FIGS. 1 to 3.

In another departure from the embodiment, staple wire supply rolls 14 and 16 can also be mounted in a cassette (not depicted) which can then be positioned on support 3 of threading-in device 2 in a suitable manner (not depicted). A cassette of this kind can completely or partially enclose supply rolls 14 and 16 in such a way that only the leading end of the wire is accessible for threading in.

The invention has been described in detail with particular reference to certain preferred embodiments thereof, but it will be understood that variations and modifications can be effected within the spirit and scope of the invention.

What is claimed is:

1. Mechanism for transporting the leading end of a staple wire from a supply roll to a stapling device for sheet stacks via a flexible guide tube for the staple wire arranged between the staple wire supply roll and the stapling device, said mechanism having a movable holder on which the staple wire supply roll is mounted, said holder with the staple wire supply spool being movable between a position arranged inside a stapling apparatus and a position projecting beyond the outside of the apparatus, characterized in that said movable holder is configured as a threading-in device (2) for at least one staple wire supply roll (14, 16), on which at least one transport mechanism (7) associated with the leading end of the supply roll (14) is arranged;

said flexible guide tube (18) leading to the transport mechanism (45, 52) of said stapling device (22 and 28, respectively) is arranged at the outlet of said transport mechanism (7) of said threading-in device (2);

a sensor (47) arranged in the transport path of the staple wire (50) is arranged on said stapling device (22, 28), and said sensor (47) is coupled to an indicating means of said threading-in device (2) which signals passage of the leading end of the wire past said transport mechanism (45, 52) of said stapling device (22 and 28, respectively); and said transport mechanism (7) of said threading-in device (2) is positively coupled via control means (36, 37) to a pressure roller (45) of said transport mechanism (45, 52) of said stapling device (22, 28) in such a way that when said threading-in device (2) is moved into said stapling apparatus (1), a pressure roller (8) of said transport mechanism (7) of said threading-in device (2) can be moved into an ineffective position, and said pressure roller (45) of said transport mechanism (45, 52) of the stapling device (22, 28) can be moved into an effective position; and when said threading-in device (2) is moved out of said stapling apparatus (1), said pressure roller (8) of said transport mechanism (7) of said threading-in device (2) can be moved into an effective position, and said pressure roller (45) of said transport mechanism (45, 52) of said stapling device (22, 28) can be moved into an ineffective position.

2. Staple wire mechanism of claim 1, wherein said transport mechanism (7) has a roller pair (8, 9) for transporting the staple wire (50), having a drivable transport roller (9) and a pivotable pressure roller (8) associated with the latter; and arranged at the inlet of the roller gap of the roller pair (8, 9) associated with the supply roll (14 or 16) is a feed-in tube (13, 13*a*), directed toward the roller gap, which is funnel-shaped at its opening (13*a*) associated with the supply roll (14 or 16).

3. Staple wire mechanism of claim 2, wherein a feed-in tube (19) into which one end of said flexible guide tube (18) opens is directed toward the outlet gap of said roller pair (8, 9).

4. Staple wire mechanism of claim 3, wherein the other end of said flexible guide tube (18) opens directly into said staple wire inlet (23) of said stapling device (22, 28).

5. Staple wire mechanism of claim 4, wherein said threading-in device (2) is arranged on a support (3) guided displaceably in the manner of a drawer on pull-out rails (4).

6. Staple wire mechanism of claim 5, wherein said support (3) has a substantially vertically arranged wall (5 or 6) on which the staple wire supply roll (14 or 16) is rotatably mounted, and on which the associated transport mechanism (7) and feed-in tube (13 or 19) are arranged.

7. Staple wire mechanism of claim 6, wherein said pressure roller (8) of said transport mechanism (7) is rotatably mounted on a pivotable lever (11) that is arranged pivotably about a stationary bearing (12) on said wall (5 or 6);

a two-armed control arm (39) is mounted pivotably about the same staionary bearing (12);

said control arm (39) and said lever (11) are joined to one another at their one end by means of a pin (33); and a spring (35) laying said pressure roller (8) against said transport roller (9) engages in the region of said pin;

a wire (37) of a sheathed cable (36) is attached at the other end of said lever (11); and a slide roller (40) associated with the housing (29) of said stapling apparatus (1) is rotatably mounted at the other end of said control arm (39).

8. Staple wire mechanism of claim 5, wherein said support (3) has two walls (5 and 6) arranged substantially vertically; and a rotatably mounted staple wire supply roll (14 or 16), with the pertinent transport mechanisms (7) and feed-in tubes (13, 19) is arranged on the opposite sides of each of said walls (5 and 6).

9. Staple wire mechanism of claim 8, wherein said pressure rollers (8) of said transport mechanisms (7) are each rotatably mounted on a pivotable lever (11) that is arranged pivotably about a stationary bearing (12) on said walls (5 and 6);

a two-armed control arm (39) is arranged between said walls (5 and 6) and is mounted pivotably about the same stationary bearing (12);

said control arm (39) and said levers (11) are joined to one another at their one end by means of a pin (33); and a spring (35) laying said pressure rollers (8) against said transport rollers (9) engages in this region;

a wire (37) of a sheathed cable (36) is attached at the other end of each lever (11); and a slide roller (40) associated with said housing of the stapling apparatus (1) is rotatably mounted at the other end of said control arm (39).

10. Staple wire mechanism of claim 9, wherein said threading-in device (2) has a guide element (17) which guides the staple wire (50) from the periphery of the supply roll (14 or 16) to said feed-in tube (13) and is arranged immovably at its one end facing said feed-in tube (13); and said guide element (17) is arranged approximately coaxially with the pivot bearing of said staple wire supply roll (14 or 16), and is configured at its other end in elastically resilient fashion.

11. Staple wire mechanism of claim 10, wherein a pivotably mounted arm (21), the free end (21*a*) of which projects out beyond the diameter of the supply roll (14 or 16), rests on the coil diameter of the staple wire supply roll (14 or 16) and exerts a braking force on said supply roll; and sensors which signal the position (21*a*, 21*b*) of said arm (21), and thus the supply of staple wire, are arranged in the movement path of said free end (21*a*).

12. Staple wire mechanism of claim 11, wherein a spindle (15) for mounting the staple wire supply roll (14 or 16) is arranged on said wall (5 or 6) of said support (3); the staple wire supply roll (14 or 16) can be axially immobilized by a securing lever (30) that is pivotable perpendicular to its rotation axis; and said arm (21) projects into the movement path of the securing lever (30) in such a way that when said securing lever (30) is opened, said arm (21) can be lifted away from said staple wire supply roll (14 or 16).

13. Staple wire mechanism of claim 12, wherein said threading-in device (2) is equipped with mutually associated guide grooves for the staple wire (50).

14. Staple wire mechanism of claim 13, wherein said stationary transport roller (9) of the threading-in device (2) is joined, for manual actuation, to a handwheel (10) having a handle (10*a*).

15. Staple wire mechanism of claim 13, wherein said stationary transport roller (9) of said threading-in device (2) is joined to a motor drive.

* * * * *